US005425353A

United States Patent [19]

Herbert

[11] Patent Number: 5,425,353

[45] Date of Patent: Jun. 20, 1995

[54] COOKING HOBS

[75] Inventor: Eric D. Herbert, Warrington, England

[73] Assignee: Pompe Developments Limited (In Liquidation), Garfoth Leeds, England

[21] Appl. No.: 102,213

[22] Filed: Aug. 5, 1993

[30] Foreign Application Priority Data

Aug. 6, 1992 [GB] United Kingdom ..... 9216690.9

[51] Int. Cl.[6] ..... F24C 3/00

[52] U.S. Cl. ..... 126/39 N; 126/39 G; 126/39 H; 126/39 J; 431/80; 431/78

[58] Field of Search ..... 126/39 N, 39 J, 39 H, 126/39 R; 431/23, 62, 63, 67, 78, 79, 90, 80; 337/394

[56] References Cited

U.S. PATENT DOCUMENTS

| | | | |
|---|---|---|---|
| 4,201,184 | 5/1980 | Scheidler et al. | 126/39 J |
| 4,267,815 | 5/1981 | Gössler | 126/39 G |
| 4,388,520 | 6/1983 | McWilliams | 219/464 |
| 4,414,465 | 11/1983 | Newton et al. | 219/449 |
| 5,024,209 | 6/1992 | Schaupert | 126/39 H |

FOREIGN PATENT DOCUMENTS

| | | |
|---|---|---|
| 0138314 | 4/1985 | European Pat. Off. . |
| 1535931 | 12/1978 | United Kingdom . |
| 2230595 | 10/1990 | United Kingdom . |

*Primary Examiner*—Larry Jones

*Attorney, Agent, or Firm*—Jacobson, Price, Holman & Stern

[57] ABSTRACT

A cooking hob comprising at least one gas burner 17, 18, 19 disposed beneath a glass top 25, said burner including a heat resistant rod 46 extending across at least part of the burner 17, 18, 19 and a thermocouple element 47 connected to the rod 46 for sensing the temperature of the glass 25 (FIG. 1).

6 Claims, 2 Drawing Sheets

COOKING HOBS

This invention relates to cooking hobs and more specifically to glass topped cooking hobs. The cooking hob may be an integral unit or it may form part of a larger appliance comprising one or more cooking ovens, grill chambers, etc. The invention is especially applicable to glass topped cooking hobs incorporating one or more gas burners disposed beneath the glass top.

BACKGROUND OF THE INVENTION

Glass topped cooking hobs incorporating electric hotplates or gas burners beneath the glass top are known and are usually provided with an over-temperature sensor which effectively senses the temperature of the glass and turns off the hotplate or gas burner when the maximum temperature of the glass has been reached. The most common method of monitoring the glass temperature is to use a rod expansion type thermostat element which extends across the hotplate or gas burner and is preset to an operating temperature and which, when actuated, causes "snap action" electrical contacts to be operated to cause the hotplate or gas burner to be turned off. A cooking hob of this form based on gas burners is disclosed in GB-A-2230595. The use of such thermostat elements suffers from the problem that it is difficult, because of the physical size of the thermostat element, to position the heat sensitive rod part in close contact with the glass, and due to the very poor heat transfer properties of the glass, the temperature actually measured by the thermostat is considerably different to that of the top of the glass, particularly when a cooking utensil is placed on the glass. To ensure that no hazardous condition can occur, such as an aluminium pan reaching its melting point if it is allowed to "boil dry", it is necessary to set the glass overheat thermostat at a considerably lower temperature to achieve the necessary margin of safety. The use of a "snap action" thermostat is necessary to avoid poor contact performance but the inherently wide operating differential with such contacts allows the glass to cool well below its optimum temperature before heat is reapplied.

An alternative method of overheat control is disclosed in GB 1535931. This makes use of a thermocouple element positioned on or very near to the glass for monitoring the glass temperature and for turning off the gas burner should an over-temperature condition be reached. Whilst the use of a thermocouple as proposed in GB 1535931 overcomes some of the problems experienced with rod-expansion type thermostat elements, it suffers from the problem that it only monitors the glass temperature at one particular point and, as has been mentioned, since the glass has very poor heat transfer properties, the overall temperature of the glass over the area of the hotplate or gas burner is not monitored.

SUMMARY OF THE INVENTION

It is an object of the present invention to provide a glass top cooking hob having at least one cooking element, which may be an electric hotplate or gas burner, having an improved glass temperature sensing arrangement.

According to the present invention there is provided a cooking hob comprising at least one heating element disposed beneath a glass top, and temperature sensing means comprising a heat resistant rod extending across at least part of said heating element and a thermocouple element connected to said rod for sensing the temperature of said glass.

It may be arranged that said thermocouple element is connected to one end of said rod or alternatively is connected to each end of said rod.

In a preferred cooking hob, it will be arranged that said heating element is of circular area, and said rod extends between different points on the circumference of said element.

It may be arranged that said heating element is constituted by a gas burner or by an electric hotplate, and the gas hob may comprise a number of such heating elements.

BRIEF DESCRIPTION OF THE DRAWINGS

An exemplary embodiment of the invention will now be described reference being made to the accompanying drawings, in which.

DESCRIPTION OF THE PREFERRED EMBODIMENTS

The cooking hob to be described is based on that which is more fully described in GB-A-2230595 already referred to, except that the gas flow to each of the gas burner units is controlled by solenoid gas valves rather than the mechanical gas valves 11, 12 and 13 (FIG. 1) as in GB-A-2230595, and also an improved form of glass temperature sensing device is included instead of the thermostat 61 (FIG. 6).

Figure 1:
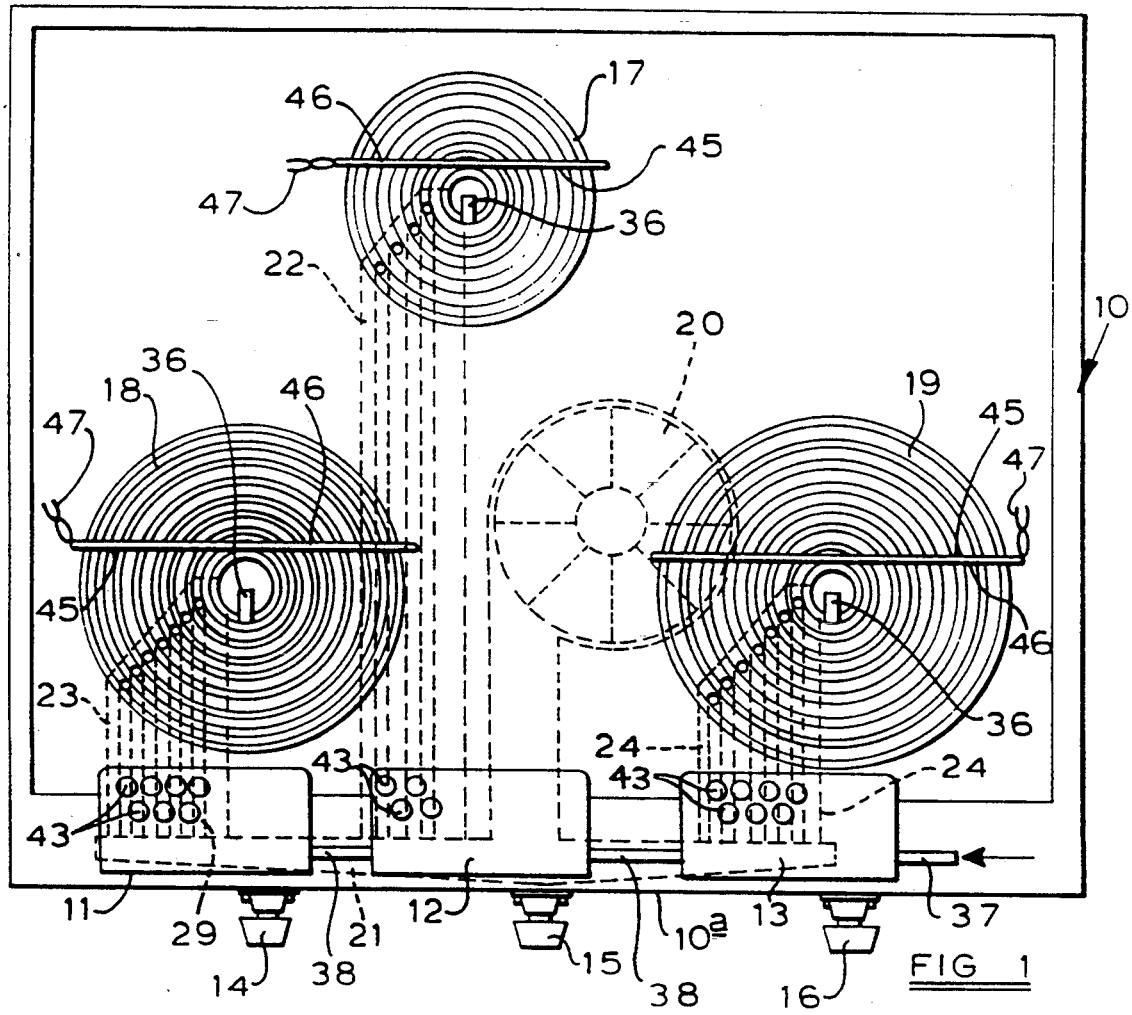
FIG. 1, is a schematic top plan view of a glass top cooking hob in accordance with the present invention, with the top glass ceramic plate removed.

The glass top cooking hob shown in FIG. 1 of the drawings has a body 10 of generally rectangular configuration, there being at the one of its longer sides constituting a front 10*a* of the hob, three solenoid operated gas flow control valves 11, 12, 13, to be described in greater detail hereafter, together with respective multi-position electrical switches 14, 15 and 16.

Within the body 10 of the cooking hob are a number of gas-fired heat radiating surface combustion burners, in this example three, namely a small diameter gas burner 17 and two larger diameter gas burners 18, 19 respectively. The gas burners 18, 19 are arranged at the front of the cooking hob adjacent the left and right sides thereof respectively, being controlled, as will be described, by the control valves 11 and 13 respectively. The gas burner 17 is positioned towards the rear of the cooking hob and slightly to the left of the centre thereof, being controlled by the control valve 12, which is disposed between valves 11, 13 along the front 10*a* of the cooking hob.

Disposed in the gas hob body below the level of the gas burners 17, 18 and 19, is an electrically driven fan 20 of common type. The fan 20 has its output volume controllable either by varying its speed or by varying its input or output orifice. The fan 20 supplies air, in use, to a plenum chamber 21 which is in communication with respective sets 22, 23, 24 of gas burner gas/air supply ducts for supplying the gas burners 17, 18, 19.

Figure 2:
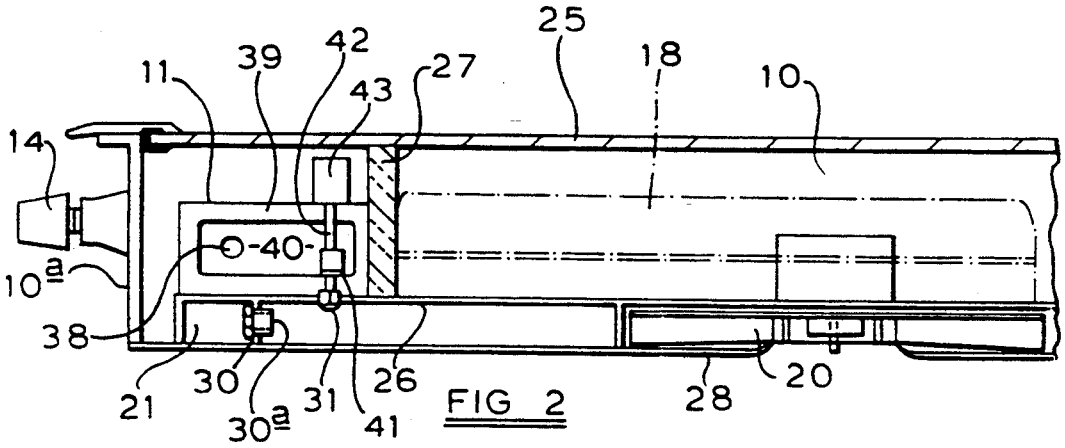
FIG. 2, is an enlarged, fragmentary schematic view on a section through the hob of FIG. 1.
Figure 3:
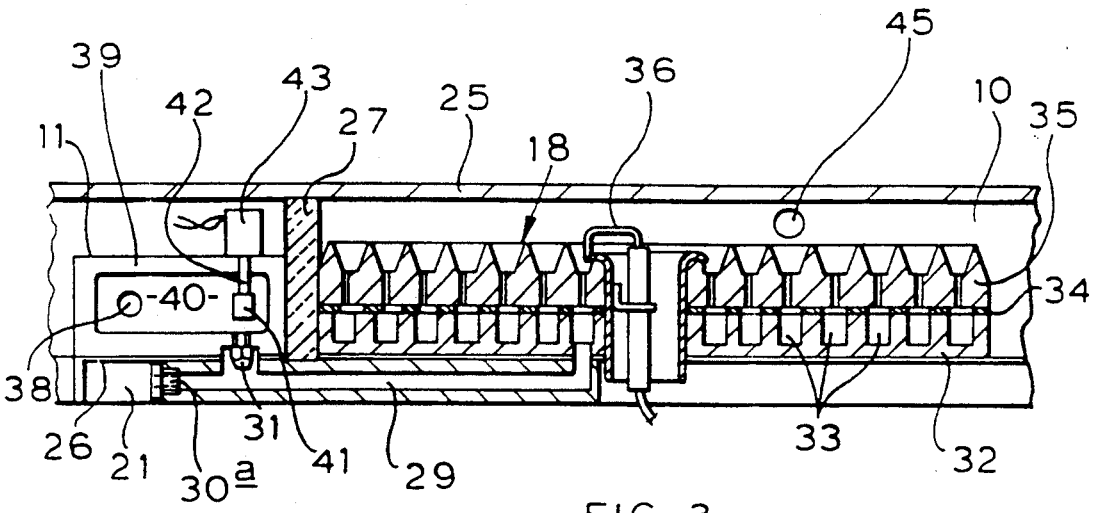
FIG. 3, is a similar view to FIG. 2, but showing detail of a gas flow passage to a gas burner, and the gas burner itself, with the gas flow passage receiving gas from a solenoid operated control valve.

As best shown in FIGS. 2 and 3, the hob body 10 has its top closed by a glass ceramic plate 25, the gas burners and the control valves (only one 18 and 11 of each shown) being disposed below the plate 25 on a supporting surface 26. The gas burners are all received closely below the plate 25, e.g. 10–20 mm. A vertical wall 27 separates the control valves from their respective associated gas burner. The cooking hob has means (not shown) at its rear for removal of gaseous combustion products.

The fan 20 is disposed between the surface 26 and a base surface 28 of the hob body 10 and the sets of supply ducts 22, 23 and 24 are at the same level as the fan 20. As shown in FIG. 1, each set comprises four or seven parallel supply ducts 29. At one end, each duct 29 has an orifice plate 30 carrying a plug 30*a* with an orifice therethrough to provide communication with the plenum chamber 21 which extends around each set of supply ducts. A short way inwardly from the plug 30*a*, each duct 29 has a gas nozzle 31 extending downwardly into it to supply gas to the duct from one of the control valves e.g. 11.

As depicted in FIG. 3, each of the gas burners 17, 18 and 19 is made up of a lower plate 32 formed with a number of concentric chambers 33, for example seven chambers for the larger gas burner units 18 and 19. Fitted on top of the plate 32, via a gasket 34, is a ceramic radiant heat emitting burner plaque or plate 35 which is perforated to match the arrangement of the chambers to provide a number of concentric gas burning rings at its top surface closely below the glass ceramic plate 25. Burner plaques of this form are disclosed in West German Auslegeschrift no. 1116615, to which reference may be made. A spark electrode 36 is brought up through a centre hole in the plates 32 and 35, so as to be able to ignite the inner burner ring which acts as a pilot light, and which is supplied with gas/air continuously whenever a gas burner is turned ON.

The other ends of the ducts 29 in each set are upwardly open to communicate with the concentric chambers 33 respectively. Supply of gas to the sets of ducts 22, 23 and 24 is governed by the solenoid operated control valves 11, 12 and 13.

The control valves 11, 12 and 13 are typically connected in series to a gas supply pipe 37, via intermediate connecting pipes 38 shown in FIG. 1. A cross-sectional view of one of the valves 11 is shown in FIGS. 2 and 3 in a valve-closed and valve-open position respectively. The valve 11 comprises a die cast metal body 39 with a separate die cast metal cover (not shown) which is screwed to the body 39, with a gasket (not shown) therebetween to form a gas tight seal. A gas tight enclosure 40 is thus formed within the body 39, the enclosure 40 is supplied with gas via gas supply pipe 38 which extends sideways into the body 39. The gas nozzle 31, already referred to, extends from the enclosure 40 into the supply duct 29 (FIG. 3). Further nozzles 31 (not shown) will extend from the enclosure 40 to the other supply ducts of the set 23. Contained within the enclosure 40 is a valve closure member 41 which is mounted on the operating shaft 42 of a solenoid 43, the solenoid 43 being mounted on the top surface of the die cast body 39. One solenoid 43, will be provided, with its operating shaft 42 and associated closure member 41, for each of the supply ducts of the set 23. It is arranged that under normal conditions as shown in FIG. 1, the closure member 41 is in contact with the nozzle 31 to prevent gas from flowing from the enclosure 40 into the duct 29. When the solenoid 43 is operated, however, the closure member 41 is lifted from the nozzle 31, as is depicted in FIG. 3, and allows gas to flow from the enclosure 40 to the duct 29. In the duct 29, the gas from nozzle 31 is mixed with air from the plenum chamber 21 via plug 30*a*, whereby a gas/air mixture is supplied to the concentric chamber 33 associated with duct 29. Operation of the solenoids 43 of the gas control valve 11 is controlled by the multi-position switch 14, by means of which any number of the solenoids 43 may be operated, thereby to control the operation of the gas burner 18.

It will be appreciated that the gas control valves 12 and 13 will be of similar construction to that of gas control valve 11 described hereinbefore, except that valve 12 will be provided with only four solenoids 43 to correspond to the four supply ducts 29 of the set 22.

Figure 4:
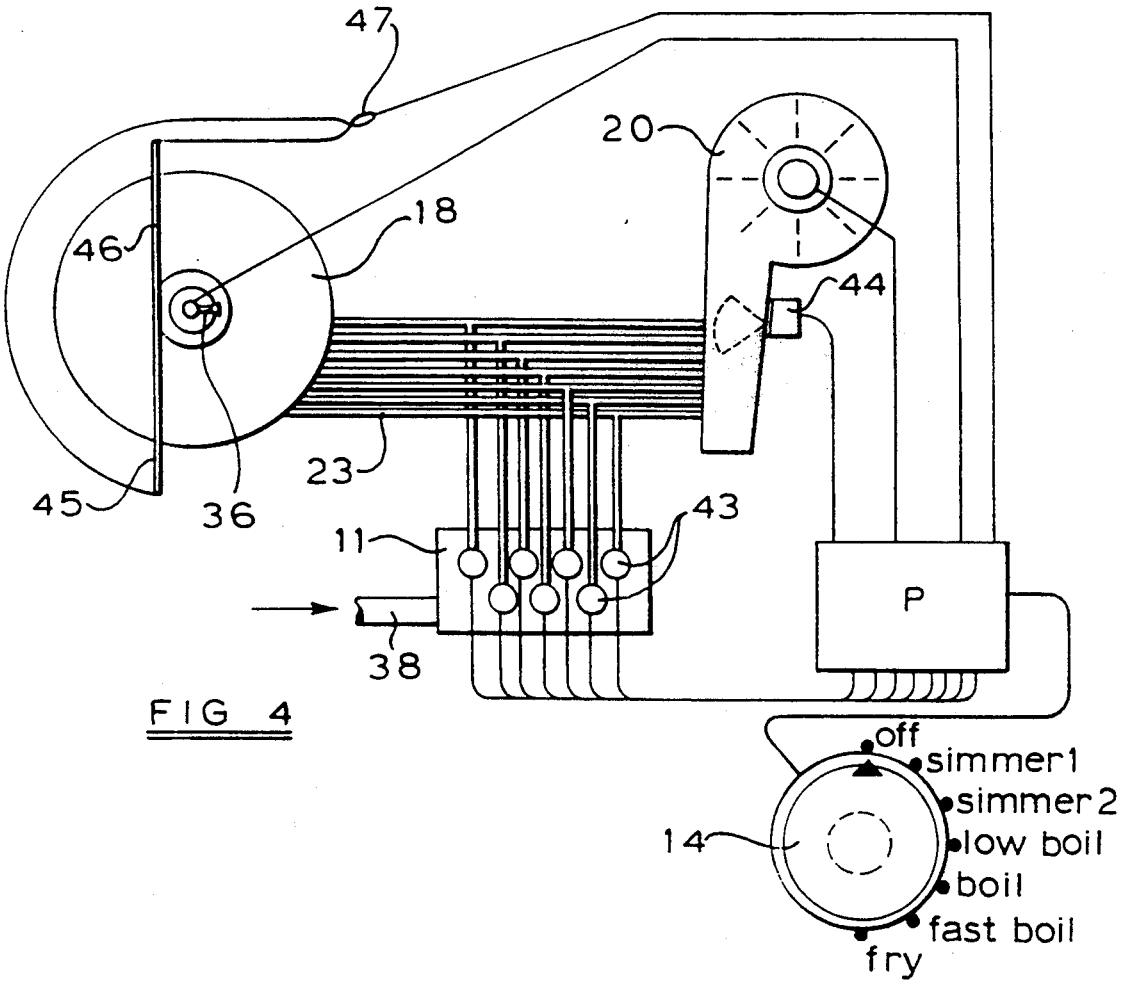
FIG. 4, is a diagrammatic view of one of the gas burners of the cooking hob of FIG. 1 together with its control system.

In FIG. 4 of the drawings there is depicted somewhat diagrammatically a typical control system for the gas burner 18 of the cooking hob of FIG. 1.

In FIG. 4, the gas burner 18 is depicted together with the set of supply ducts 23 by means of which forced air from fan 20 and gas from control valve 11 are fed to it. The control valve 11 is fed from gas supply pipe 38 and is provided with seven solenoids 43 for controlling gas flow to the individual gas ducts 29 of the set of ducts 23. The multi-position switch 14 is shown, which typically may be rotatable to positions corresponding to "OFF", "SIMMER 1", "SIMMER 2", "LOW BOIL", "BOIL", "FAST BOIL" and "FRY". In this respect it will be appreciated that one of the solenoids 43 would be provided for controlling pilot light gas to the burner 18. The outputs from the multi-position switch 14 are fed to a microprocessor P from which outputs are connected to the solenoids 43 of control valve 11. The microprocessor P also affords outputs to the fan 20 and to the spark electrode 36 and also receives inputs from a pressure sensor 44 which detects when the fan 20 is operating and also from a glass temperature sensor 45 which is disposed above the burner 18 and beneath and in close proximity to the glass 25 as depicted in FIG. 3. It will be appreciated that each of the burners 17, 18 and 19 will be provided with a glass temperature sensor 45 as is depicted in FIG. 1. The glass temperature sensors 45 typically consist of a heat resistant, typically stainless steel, rod 46, which extends across the respective burner between different points on the circumference thereof, and a pair of thermocouple wires 47 crimped or brazed to either one end of the rod 46 as in FIG. 1 or to opposite ends of the rod 46 as in FIG. 4. The use of the thermocouple wires 47 in combination with the rod 46 allows the rod to be positioned in close contact with the glass and enables the temperature of the glass 25 to be determined over the length of the rod 46, thereby achieving a more accurate temperature indication than conventional thermocouple sensors.

Typically, the control system of FIG. 4 may operate as follows:

Under normal conditions when the switch 14 is set to its "OFF" position, the solenoid 43 associated with the inner concentric chamber 33 of the burner 18 may be energised to provide a pilot light therefor. When the switch is turned to its "SIMMER 1" position, the solenoid 43 associated with the concentric chamber 33 adjacent the inner chamber is energised under the control of the microprocessor P. Similarly, as each position of the switch 14 is selected, the solenoid 43 corresponding to the next outer concentric chamber 33 is energised, so that as the switch 14 is switched from "OFF" to "FRY", each of the concentric chambers 33 of burner 18, starting from the inner chamber, are successively energised. Should, for any reason, the microprocessor P detect from pressure sensor 44 that the fan 20 is not working or should it detect an over-temperature condition from the glass temperature sensor 45, it immediately de-energises the solenoids 43 to cut-off gas supply to the burner 18.

Because the glass temperature sensors 45 afford an accurate indication of glass temperature, it is envisaged that in order to reduce the warm-up time of the gas burners, e.g. 18, that when the switch 14 is turned to any of its positions, all of the concentric chambers 33 of the gas burner 18 are initially supplied with gas under the control of the microprocessor P and solenoids 43, so that the gas burner reaches its operating temperature very quickly. The temperature of the glass 25 of the gas burner 18 is closely monitored by the microprocessor P by means of the glass temperature sensor 45, and when the maximum permitted glass temperature is reached, the concentric chambers 33 of the gas burner 18 are successively turned off by de-energising their respective solenoid 43, starting with the outer concentric chamber 33, until only those chambers 33 corresponding to the selected switch position of the switch 14 are supplied with gas.

It should be appreciated that the embodiment of the invention which has been described has been given by way of example only and may be modified to suit any required application. For example, the provision of the microprocessor P is not essential for the operation of the cooking hob, in which case energisation of the solenoids 43 of each of the gas burners 17, 18 and 19 may be controlled directly by the respective switches 12, 11 and 13. Also, a "size of pan" control may be provided, preferably associated with one or both of the larger gas burners 18 or 19 which enables either all of the concentric chambers of the gas burner 18 or 19 to be energised or, when a relatively small pan is being used, enables only, say, the five inner chambers to be energised, thereby preventing the outer chambers which are not in contact with the pan from being energised.

I claim:

1. A cooking hob comprising at least one heating element disposed beneath a glass top, and temperature sensing means consisting solely of a heat resistant rod which extends across at least part of said heating element and which is directly heated thereby and a thermocouple element attached to said rod for sensing the temperature of said glass.

2. A hob as claimed in claim 1, in which said thermocouple element is connected to one end of said rod.

3. A hob as claimed in claim 1, in which said thermocouple element is connected to each end of said rod.

4. A cooking hob as claimed in claim 1, in which said heating element is of circular area, and said rod extends between different points on the circumference of said element.

5. A cooking hob as claimed in claim 1, in which said heating element is constituted by a gas burner.

6. A cooking hob as claimed in claim 1, in which said heating element is constituted by an electric hotplate.

* * * * *